US006932749B2

(12) United States Patent
Barnes et al.

(10) Patent No.: US 6,932,749 B2
(45) Date of Patent: Aug. 23, 2005

(54) DEVICE AND METHOD FOR KINESIOLOGICALLY CORRECT EXERCISE AND REHABILITATION

(76) Inventors: Neal Barnes, 6246 Zealand Ave. N., Mpls., MN (US) 55428; Jonathan H. Monti, 34 Carriage Way, North Providence, RI (US) 02904

( * ) Notice: Subject to any disclaimer, the term of this patent is extended or adjusted under 35 U.S.C. 154(b) by 0 days.

(21) Appl. No.: 10/125,473

(22) Filed: Apr. 19, 2002

(65) Prior Publication Data

US 2002/0151419 A1 Oct. 17, 2002

Related U.S. Application Data

(63) Continuation of application No. 09/428,708, filed on Oct. 28, 1999, now Pat. No. 6,387,024, and a continuation-in-part of application No. 08/869,048, filed on Jun. 4, 1997, now abandoned.

(60) Provisional application No. 60/036,861, filed on Feb. 3, 1997, and provisional application No. 60/019,378, filed on Jun. 5, 1996.

(51) Int. Cl.[7] ..... A63B 21/00

(52) U.S. Cl. ..... 482/142; 130/137

(58) Field of Search ..... 482/97, 137, 139, 482/10, 136, 138, 140, 130, 142, 112

(56) References Cited

U.S. PATENT DOCUMENTS

| | | | | |
|---|---|---|---|---|
| 2,494,094 | A | | 1/1950 | Hortsman |
| 2,598,204 | A | | 5/1952 | Allen |
| 3,674,017 | A | | 7/1972 | Stefani, Jr. |
| 4,241,914 | A | | 12/1980 | Bushnell |
| 4,387,894 | A | | 6/1983 | Baumann |
| 4,725,054 | A | | 2/1988 | Solow et al. |
| 5,094,445 | A | | 3/1992 | Winkelvoss |
| 5,100,131 | A | | 3/1992 | Fong |
| 5,277,684 | A | * | 1/1994 | Harris |
| 5,322,489 | A | | 6/1994 | Webb et al. |
| 5,324,247 | A | | 6/1994 | Lapley |
| 5,372,556 | A | | 12/1994 | Ropp |
| 5,421,800 | A | | 6/1995 | Mullen |
| 5,624,353 | A | * | 4/1997 | Naidus |
| 5,665,041 | A | | 9/1997 | Hsieh |
| 5,702,334 | A | | 12/1997 | Lee |
| 5,833,590 | A | | 11/1998 | Chiu et al. |
| 6,059,701 | A | | 5/2000 | George et al. |
| 6,090,022 | A | | 7/2000 | Colecchi |
| 6,387,024 | B1 | * | 5/2002 | Monti et al. |

* cited by examiner

*Primary Examiner*—Jerome W. Donnelly
(74) *Attorney, Agent, or Firm*—Welsh & Flaxman LLC

(57) ABSTRACT

The present invention provides a means of exercising wherein the gross body movements of the body during exercise are Kinesiologically Correct, meaning they are governed by the specific forces, specific physiology and specific mechanics according to the natural movements of the body when effected by gravity. The body is supported during the body weight resistive exercise in such a way that the body is maintained in a position the body naturally tends toward when unassisted during a body weight resistive exercise accomplished by the way in which the user interfaces with the machine. In performing assistive exercises, wherein the weight of the user's body is made lighter, the user's body is being pushed upon by the guide arm of the machine while force is being applied to the guide arm through a bi-direction force transferring means. In performing resistive exercises, wherein the weight of the user's body is made heavier, the user is pulling upon or harnessed to the guide arm of the machine while force is being applied to the guide arm through a bi-directional force transferring means. The force engine comprises a force production mechanism and a force transferring means in which the force is created by the force production mechanism and transferred to the guide arm of the machine by the force transferring means.

33 Claims, 10 Drawing Sheets

DEVICE AND METHOD FOR KINESIOLOGICALLY CORRECT EXERCISE AND REHABILITATION

BACKGROUND—CROSS-REFERENCES TO RELATED APPLICATIONS

This application is a continuation of U.S. patent application Ser. No. 09/428,708, filed Oct. 28, 1999 now U.S. Pat. No. 6,387,024, entitled "Device and Method for Kinesiologically Correct Exercise and Rehabilitation, which is currently pending. The invention refers to the invention disclosed in the provisional application of Jonathan H. Monti for an "Exercise and Rehabilitation Device", Ser. No. 60/019,378, filed Jun. 5, 1996, the provisional application of Jonathan H. Monti for an "Assisted Push-Up Exercise Device", Ser. No. 60/036,861, filed Feb. 3, 1997, and the application is a continuation in part of U.S. patent application Ser. No. 08/869,048,filed on Jun. 4, 1997, which is now abandoned.

BACKGROUND—FIELD OF INVENTION

This invention relates generally to exercise machines for body weight resistive exercises and to the method of exercising wherein the gross body movements of the body through a desired range of motion are governed by the specific forces, specific physiology and specific mechanics of human movement.

BACKGROUND—PRIOR ART AND SUMMARY OF THE INVENTION

In recent years, physical therapists and sports trainers alike have been emphasizing the use of natural, multi-joint, functional and biomechanically specific body weight resistive exercises in the routines that they design. However, most physical therapy patients and beginning exercisers are not in condition to handle their own body weight with proficiency usually due to one or more of the following factors: (1) injury, (2) lack of strength in a particular muscle group, (3) gross weakness of the entire body, (4) excessive body weight. Therefore, there is a need for a mechanism that can create a sense of less weight. However, on the other end of the spectrum, avid exercisers and elite athletes may have strength training requirements that exceed the use of just their own body weight. Therefore, there is a need for a mechanism that can also create a sense of added body weight.

Exercise devices for resisting a person performing exercises and particularly adding resistance to body weight resistive exercises is well known in the prior art. For example see U.S. Pat. No. 5,356,359 to Simmons and U.S. Pat. No. 5,669,860 to Reyes. Exercise devices for assisting a person performing body weight resistive exercises is also known. These known body weight assisting exercise devices typically only provide assistance. Therefore, when a person can perform the exercise without assistance, these assisting devices provide no means for resisting the exerciser and allowing for the realization of further strength gains past their own body weight.

An exercise device for the use of assisting or resisting a plurality of exercises is also known. This U.S. Pat. No. 4,241,914 to Bushnell is a device that can do this but the method in which it was conceived is entirely different than the present invention. Bushnell uses rubber bands to contact the dorsal and or ventral parts of the torso while it moves with the body through a range of motion.

The present invention has found a way to assist a user during exercise through a desired range of motion of the exercise while also providing a means for resistance should the user chose to perform resistive exercises. The present invention is a variable gravity machine that contacts the user in the same anatomical sites as Bushnell, however, the difference being that it has a pivotally mounted guide arm that is acted upon to provide force in a particular direction according to the desired use.

The present invention provides a means of exercising wherein the gross body movements of the body during exercise are Kinesiologically Correct, meaning they are governed by the specific forces, specific physiology and specific mechanics according to the natural movements of the body when affected by gravity. The body is supported during the body weight resistive exercise in such a way that the body is maintained in a position the body naturally tends toward when unassisted during a body weight resistive exercise. The exercises performed with the variable gravity machine are gross body movements, multi-joint exercises and provide for either assistance through a desired range of motion or with an adjustment of the guide arm, provide added resistance through a desired range of motion. It is accomplished by the way in which the user interfaces with the machine. In performing assistive exercises, wherein the weight of the user's body is made lighter, the user's body is being pushed upon by the guide arm of the machine while force is being applied to the guide arm through a bi-direction force transferring means. In performing resistive exercises, wherein the weight of the user's body is made heavier, the user is pulling upon or harnessed to the guide arm of the machine while force is being applied to the guide arm through a bi-directional force transferring means.

The force can be provided by a variety of force engines. The force engine comprises a force production mechanism and a force transferring means in which the force is created by the force production mechanism and transferred to the guide arm of the machine by the force transferring means. Examples consist of an iron disk plate on the end of a pivotally mounted weight arm (as seen in the related U.S. Pat. Noland et al and U.S. Pat. Mclaughlin et al. and Hammer Strength® type machines); the weight from a selectorized weight stack; or any other weight assembly, as seen in most Nautilus® type exercise machines.

The present invention can use any type of force engine, one being a bi-directional cam that can be mounted to the machine on the side or in the middle of the weight stack embodiment as seen in the prior art multi-hip machine. Also related are the biceps curl/triceps extension, leg curl/leg extension machines and the Nautilus® type back extension/ab crunch machines. The second being the adjustable angle bi-directional torque producing guide arm and weight arm unit as seen in the prior art of Noland et al. and particularly by Tuff Stuff® and Body Solid® which are arm and leg machine variants that are not subject to the present invention. These machines are used only to produce a resisting force for arm or leg exercises. The third being a bi-directional cam and under carriage pulley mechanism as seen in the prior art of Nautilus® Power Plus® line of exercise equipment. The Power Plus® by Nautilus® only moves in one direction unlike the present invention embodiment related to the form, which rotates in two directions. The fourth being a bi-directional cam attached to a lever arm as seen in the biceps curl and triceps extension machines of the Hammer Strength® line. These machines only move in one direction to provide resistance for arm exercises. The present invention utilizes similar force production mechanisms as the prior art but it is tailored so it can rotate in two directions. The fifth being a retrofit to a electro mechanical (for example Cybex® by Cybex® division of Lumex®) device. These devices are widely used by physical therapists mostly for single joint exercises such as arm or leg exercises. A greater object of this invention is that it will allow physical therapists to perform body weight resistive exercises with special populations. It may be possible that this retrofitting technology may be able to give physical therapists another tool to help severely injured people. A sixth force production mechanism is the preferred embodiment of the invention, a gas spring and dial plate mechanism. The dial plate is comprised of circumferentially drilled periphery holes with one end of the gas spring connected to a notched slot in the dial plate. The notched slot allows for selection of varying force created by the gas spring.

GENERAL OBJECTS OF THE PRESENT INVENTION

It is the greatest general object of the present invention to provide a greater and more medically accepted exercise and rehabilitation technology. It is another general object of the present invention to combine age old functional body weight resisted exercises with the applicant's technology. It is still another general object of the present invention to reduce the art of exercise and rehabilitation to its simplest form. It is still another general object of the present invention to realize a greater scope in the art and science, which can be characterized as Kinesiologically Correct.™ Additionally, this can further be explained as the performance of body movements that are specific to the natural movements of the body, both physiologically and mechanically, as opposed to the prior art, which only can claim that it is correct mechanically. Still further explained as specific muscles or muscle groups moving with the specific forces that they synergistically provide in nature. For example pulling with the back, and pulling with the abdominal muscles and not pushing with either, which is the core movement of many prior art machines. Still further explained as the direction of movement of the muscle fibers of particular muscles from the respective insertion to origin of a particular muscle or group of muscles. It is still another further general object of the present invention to provide a technology that compliments and adds a new dimension to the mission of physical health care professionals.

SPECIFIC OBJECTS OF THE PRESENT INVENTION

It is the greatest specific object of the present invention to provide an exercise technology that imparts particular forces on particular parts of the body to make it physically lighter or heavier. Making particular parts the body lighter, in essence creating a buoyancy effect, allows body weight resistive exercises to be doable and useful for physical therapy patients and beginning exercisers. Making particular parts of the body heavier, allows avid exercisers and elite athletes to realize progressive strength gains with added resistance that exceeds their own body weight. It is important to note that avid exercisers and elite athletes can benefit in many ways by using the assistive force as well. Some of these advantages would be the use of the present invention technology for warming up, active assisted stretching, endurance type training, and targeting of particular muscles differently then the prior art had allowed them to.

It is still a further specific object of the present invention that the principles that embody the technology allow for an excellent mode of quantitatively measuring progress. To further explain, the following example is provided: if an exerciser starts off at 80% assistance of a particular body part and in two weeks is performing the same type of exercises with 20% assistance of that same body part there is empirical evidence of progress which can be quantitatively measured. It is still a further specific object of the present invention to allow an exerciser the ability to perform movements that would be extremely difficult to do unless one possessed enormous strength, for example, doing a glute ham extension with one leg. It is still a further specific object of the present invention that the guide arm of this invention provides a smoother and less violent force or resistance on the muscle than if the exercise was done without the machine as seen in the prior art. It is still a further specific object of the present invention that an exerciser can perform exercises in short arcs, such as fifteen degrees in a range of motion.

FURTHER OBJECTS AND SPECIFIC ADVANTAGES OF THE PRESENT INVENTION

It is the most specific object of the present invention for the desired functions of the force engines to impart force on multi-joint body weight resistive exercises. In the prior art the intent of these force engines was not for body weight resistive exercises, it was to provide force for adding resistance to a particular biomechanical movement, and in most cases these movements were single joint and not synergistic. This is unlike the movements of the present invention which are multi joint and synergistic. Therefore, a new and novel way to exercise is realized over the prior art with the present invention.

The present invention is used to provide the before mentioned forces to the following body weight resistive exercises: 1) prone back extensions 2) push ups 3) sit ups and 4) lower abdominal flexion.

Methods and devices for exercising the back and more particularly the lower back and postural musculature is excessively stated in the prior art. Most of these devices utilize a basic movement of which can be characterized as back extension. A back extension is the backward movement of the torso and upper body to straight posture. Kinesiologically, this is characterized by the pulling of the lower back and postural muscles to extend the torso so that a person can assume straight posture. Many Nautilus® type machines have been constructed in the prior art to mimic this movement and add resistance to it, biomechanically, the core movement of this type of machine was a pushing movement. This is a distinct disadvantage of the prior art methods of back extension. Also, this does not fall within the scope of Kinesiologically Correct™ which has been stated already hereinbefore.

Another form of back extension is the prone body weight resistive type. This movement is done when an exerciser is in a prone position, thereby allowing gravity to affect the weight of the torso. The exerciser now controls and declines their torso and then returns to a parallel position, thereby exerting force on the lower back and postural musculature.

In making the torso lighter when conducting a back extension on the present invention, several advantages are realized. The most specific and greatest general advantage of the present invention is that it allows the user who is a patient in physical therapy and exercisers of particular or gross weaknesses the ability to perform prone body weight resistive back extension and related exercises that they normally would not be able to do with any of the devices or methods of the prior art. Another greater and specific advantage of the present invention is that the counter balance buoyancy effect takes the emphasis off of the larger musculature namely the hamstrings and glutes and puts it on the para spinal muscles of the lower back. Another specific advantage of this present invention is that the exerciser can twist at the top of the range of motion, this targets one para spinal which is very difficult to realize in any of the prior art methods. A further specific advantage of this present invention is that extension exercises can be performed unilaterally with one leg. A still further specific advantage of the present invention is that it is performed with a Kinesiologically Correct™ pulling movement as opposed to the prior art Nautilus® type machines that perform an incorrect and unnatural pushing movement hereinbefore described. In making the torso heavier the present invention imparts a very challenging mode of Kinesiologically Correct™ movements.

Our most natural form of resistive exercise is the push up. This exercise develops strength and muscle tone in the whole upper body. It also develops stabilizing endurance in the spinal and abdominal musculature. Other ways of developing strength in the chest and upper body are widely used, for example the bench press. This exercise can be duplicated in many different ways. Whether the angle that the exercise is performed on, or the mechanism that provides the force it is still done by abducting the humorous from the upper torso by bending at the elbow and then adducting the arm by contracting the muscles of the chest with the accompaniment of the shoulder and triceps musculature of course. Physiologically, the disadvantages of this prior art is that abducting the arm from the upper torso with weight resistance puts an enormous amount of stress on the connective tissue and fascia of the chest and shoulders resulting in very severe and painful delayed onset of muscle soreness. These symptoms are compounded three-fold for a person who has never exercised before. Mechanically, most of the prior art machines designed for the chest move in a restricted plane of motion. A further disadvantage is that the user has to start the exercise in a pre stretched position. A still further disadvantage is that improper seat placement on prior art machines may cause damaging stress to the shoulder and may even result in impingement. A still further disadvantage is that the prior art methods of exercising the chest, only exercised the chest, shoulder, and triceps musculature, not the entire body, like the present invention. Still a further disadvantage of the prior art machines is that there is no means of providing a close grip for targeting the triceps.

The greatest and most general advantage of the present invention is that it allows patients in physical therapy and exercisers of particular or gross weaknesses the ability to perform body weight resistive push ups. Another very important specific advantage is that it lessens the amount of delayed onset muscle soreness. Another specific advantage is that the body moves freely in a prone position according to gravity, as opposed to being fixed in a supine position and letting the barbell, dumbbell or before mentioned force production mechanism delineate the articulation about the shoulder. Still another further specific advantage is that the exerciser can perform close grip push up exercises which targets the triceps musculature. Still another further specific advantage is that the wrist is in a strong position as opposed to being flexed when doing pushups on the floor. Still another further specific advantage is that the handles of the machine rotate which allows for different hand placement while performing different exercises. This advantage also allows the exerciser to pronate and supinate in conjunction with pushing up. Still another further specific advantage is that the exerciser can perform push ups with their hands out at two and ten o'clock. While performing the exercise in this fashion, the user exercises the rhomboid and tres minor of the rotator cuff because the shoulder blade is adducted and then abducted. This movement is seen in the prior art method of doing superman push ups.

The sit up is a well known but widely misused mode of exercising the abdominal muscles. Many devices have been conceived and accepted by the consuming public but these devices could only be used by very coordinated or strong individuals. Some examples of these devices are the Ab Roller Plus®, the AB Works® by Nordic Track®, the AB Bench® by Icarian®, and many forms of selectorized machines. All of these devices allow the exerciser to push or pull with their arms in conjunction with the core movement which limits the effect of the abdominal muscles in the performance of the exercise. Additionally, most of the selectorized machines usually cause the exerciser to push down in an unnatural position. They also cause the exerciser to hook their feet. There are several disadvantages of these forms. The disadvantages are that the user should pull with their abdominal muscles not push. The hooking of the feet causes most of the movement to be done by the hip flexor muscles.

The greatest and most general advantage of the present invention is that it allows a patient in physical therapy or an exerciser of particular or gross weaknesses the ability to perform supine sit up exercises which constitutes form and volume. Another specific advantage of the present invention is that it does not require the exerciser to hook their feet and thereby guarantees that the abdominal muscles are being used to perform the exercise. The present invention imitates a person doing the exercise on the floor without a machine. Another very important specific advantage of the present invention species is that it simply mimics that natural movement of the sit up and provides an "assistive" force to the back of the exerciser's torso thereby allowing them to perform the exercise both correctly and in greater volumes. Another specific advantage of the present invention species is that the exerciser can create a vacuum in their abdomenopelvic cavity as they perform sit up exercises. This allows the user to concentrate on targeting the transversus abdominous, which is a deep layer muscle that is very difficult to recruit. Another further specific advantage of the present invention is that it allows the exerciser to move with self regulated force. For example, one may perform five repetitions on the present invention while really forcefully contracting the abdominal muscles. During the same set of repetitions, the exerciser can reduce the amount of force they provide during the contractions. This would be very difficult to do, if not impossible, with any of the prior art methods or machines. Still another specific advantage is that the present invention allows the exerciser to do the exercises with decreased or no pull on the neck. Still another further specific advantage is that the abdominal muscles have to contract eccentrically in the declining phase of the movement because the body does not return to the ground in an exhaustive manner to get ready for the next repetition, as is common when witnessing someone becoming fatigued as they perform manual sit ups. Still another further and important specific advantage is that the lower back is cradled and stays in contact with the adjacent surface while the exerciser performs the movement. Still another advantage is that combination exercises can be done on the present invention, for example, flexing the leg and bringing the knee to the chest while sitting up. In the prior art combination movements are not possible because the feet are hooked most of the time. Still another and very profound specific advantage of the present invention is that there is no known art or method that is better at targeting and exercising the abdominal muscles.

Lower abdominal flexion is very difficult to do and it takes some time to develop enough strength to exhibit proficiency and it is almost always done incorrectly. When performing this exercise a person should tilt their hips forwards and upwards at the end of the movement, however, because of the weight of a persons legs and strength required to move the hips in the before mentioned manner, an exerciser would have a lot of difficulty performing this exercise, until now. The greatest and most general advantage of the present invention is that is allows patients in physical therapy or an exerciser of particular or gross weaknesses the ability to perform a leg or knee lift to the chest while in a vertical or inclined position. Another specific advantage of the present invention is that the assistance allows the participant to lift their legs and tilt their hips in the before mentioned manner. Still another specific advantage is that it allows an exerciser to perform the exercise correctly. Still another and very profound specific advantage of the present invention is that it is much better than the practiced methods in the prior art of raising the knees to the chest for the purpose of exercising the lower abdominal muscles.

The reason why no one has thought of the solution disclosed in the present invention before is because of its simplicity and the basic principles that embody the technology. The prior art machines have been a continuation or an evolution of the Nautilus® and Hammer Strength® philosophies and technologies, and the designers of these machines have subsequently attempted to improve upon this technology and thereby overlooked a more simple and natural way of doing exercises.

DETAILED DESCRIPTION OF THE DRAWINGS

Figure 1:
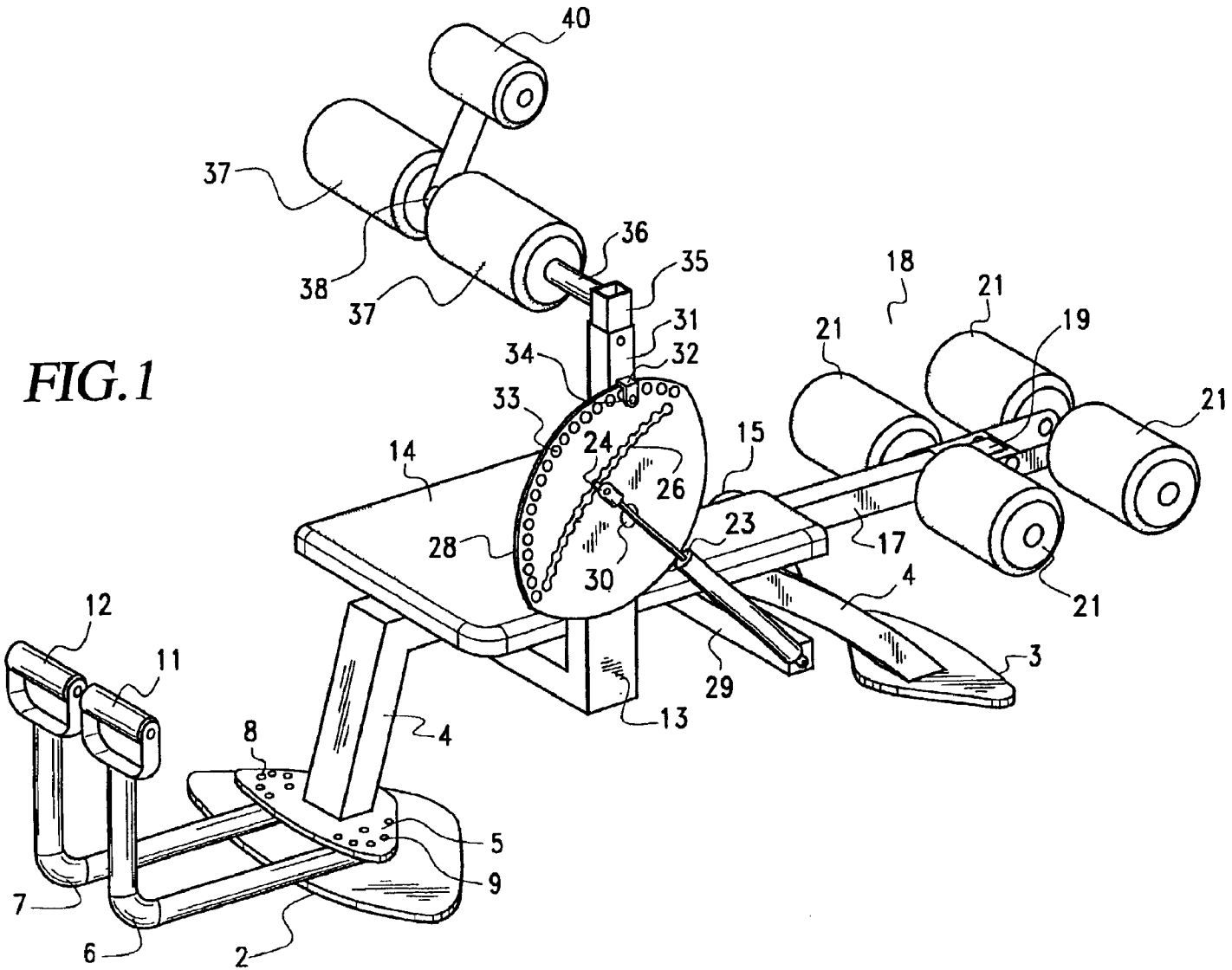
FIG. 1 is an isometric view of the variable gravity machine.

Referring now to the drawings in which like numerals represent like parts throughout the various species and their variants.

Figure 2:
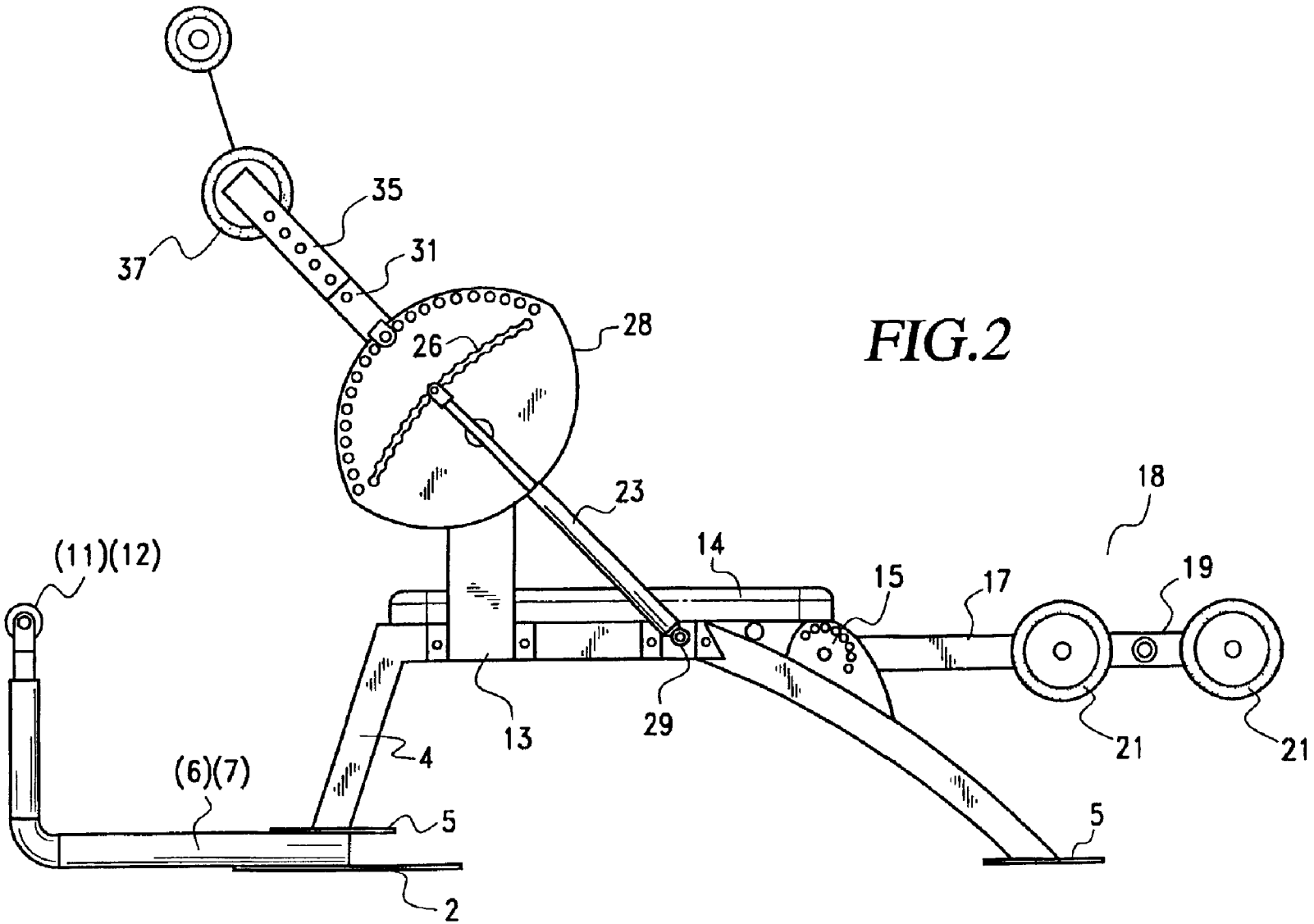
FIG. 2 is a side view of the variable gravity machine.

FIG. 1 is a isometric view of the variable gravity machine (1). FIG. 2 is a side view of the variable gravity machine(1). The variable gravity machine (1) is comprised of a front foot (2) and a rear foot (3) which support and stabilize the machine at the base level. A main central support and stabilizing member (4) is bent and angled to extend and connect to the front foot (2) and the rear foot (3). An adjusting and stabilizing member (5) is attached to the lower front to the main central support and stabilizing member (4) and is spaced accordingly from the front foot (2) in order to provide appropriate space for a pair of longitudinally extending stirrups (6) and (7). The adjusting and stabilizing member (5) comprises two sets of a plurality of holes (8) and (9) which are circumferentially drilled on each edge for the purpose of receiving a pin (10) that will lock the stirrups (6 and (7) in place at a desired angular adjustment. A pair of rotatable handles (11) and (12) are pivotally mounted to the top of each stirrup (6) and (7), respectively. Two holes are drilled in the adjusting stabilizing member (5) and the front foot (2). A hole is drilled in each stirrup (6) and (7). These holes are lined up respectively so a bolt can be journalled there through to provide an axis. A supporting and pivotal reference member (13) is bent at a right angle and attached to the main central member (4). A body pad (14) is attached to the main central support and stabilizing member (4) by a hinge (not shown). The body pad (14) is also comprised of an angular adjustment member (not shown) for the purpose of adjusting the variable gravity machine (1) for different exercises. A second adjusting and stabilizing member (15) is attached to the rear portion of the main central supporting and stabilizing member (4). This adjusting and stabilizing member (15) comprises a plurality of holes (16) which are drilled circumferentially on the periphery. The adjusting and stabilizing member (15) is used to support and angularly adjust the female telescopic member (17) of the lower body support (18). The male telescopic member (19) of the lower body support (18) is slidably adjustable and comprises holes for the purpose of receiving a pin (not shown). The lower body support (18) also comprises four rollers (21) and an H-shaped member (20). The lower body support (18) can also have an adjustable and locking member (not shown) and a foot stabilizing member (not shown). The H-shaped member (20) is pivotally mounted to the male telescopic member (19) and the four rollers are attached to the H-shaped member (20) by a respective shaft to each of the four rollers. As seen enlarged in FIG. 3, a gas spring (23) is the force production member of the variable gravity machine (1). The gas spring (23) is comprised of a male cylinder (23*a*) and a female cylinder (23*b*) and adjusting member (24) at the end of the male cylinder (23*a*). The adjusting member (24) can be adjusted along a notched slot force adjustment mechanism (26) which is fabricated in the dial plate force transferring mechanism (28). The opposite end of the gas spring (23) is mounted on a supporting member (29). The force transferring mechanism (28) is pivotally mounted on an axis shaft (30) which is journalled on a rotational device that is mounted in the supporting pivotal reference member (13). A guide arm (31) is also pivotally mounted on the axis shaft (30) which is mounted in the supporting and pivotal reference member (13) and has a rotational relationship with the force transferring mechanism (28). A U shaped member (32) is attached to the guide arm (31) and has an adjacent relationship with the dial plate force transferring mechanism (28). A plurality of holes (33) are circumferentially drilled on the periphery of the dial plate force transferring mechanism (28) to receive the bore of a detent and clamping mechanism (not shown) which is mounted to the U shaped member (32). This relationship is for the purpose of adjusting the angle and starting point of the guide arm (31). A male telescopic member (35) is slidably adjustable and comprises holes for the purpose of receiving a pin (not shown). A hollow tube (36) is connected to the male telescopic member (35) to serve as the foundation for two padded rollers (37). The hollow tube (36) also has a slot (38) drilled in the middle to receive the engaging portion of the head rest (40). The hollow tube (36) also serves as a foundation for the sit up added resistance harness-like means (not shown). This harness-like means is used for the purpose of giving the user something to pull on when they perform added resistance sit ups. The hollow tube (36) also comprises a ring (not shown) which is used when the user hooks a belt to it for the purpose of providing a connection to the machine for added resistance pushups or lower abdominal flexion. A shroud (not shown) covers the force production mechanism and force transferring means.

An additional feature of the lower body support (18) is for a means to be provided for setting the rollers (21) in place so that each set of two are lined up one on top of the other perpendicular to the floor. There is also a foot plate (not shown) tht is attached a desired distance from the rollers (21). This is so the user can push their toes against the foot plate creating another way to make the exercise closed chain. Another feature is to pad the back of the foot plate for the purpose of providing another form of the lower body support (18) for a sit up exercise. Lastly, a pair of straps (not shown) with a hook and loop feature can be attached to the lower body support (18) for the purpose of providing stability for resistive sit ups.

Figure 3:
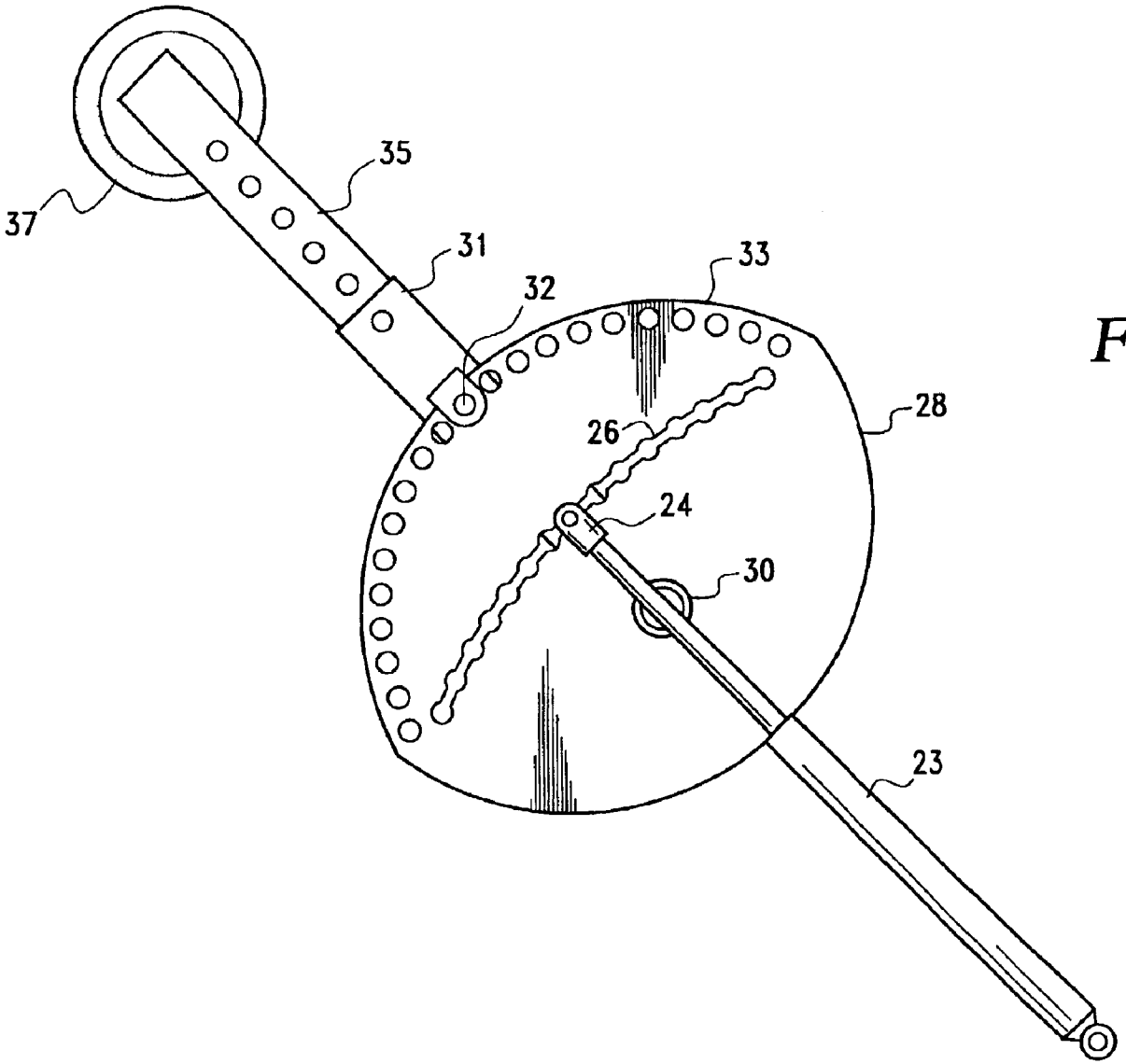
FIG. 3 is an exploded view of the force engine in neutral position.
Figure 4:
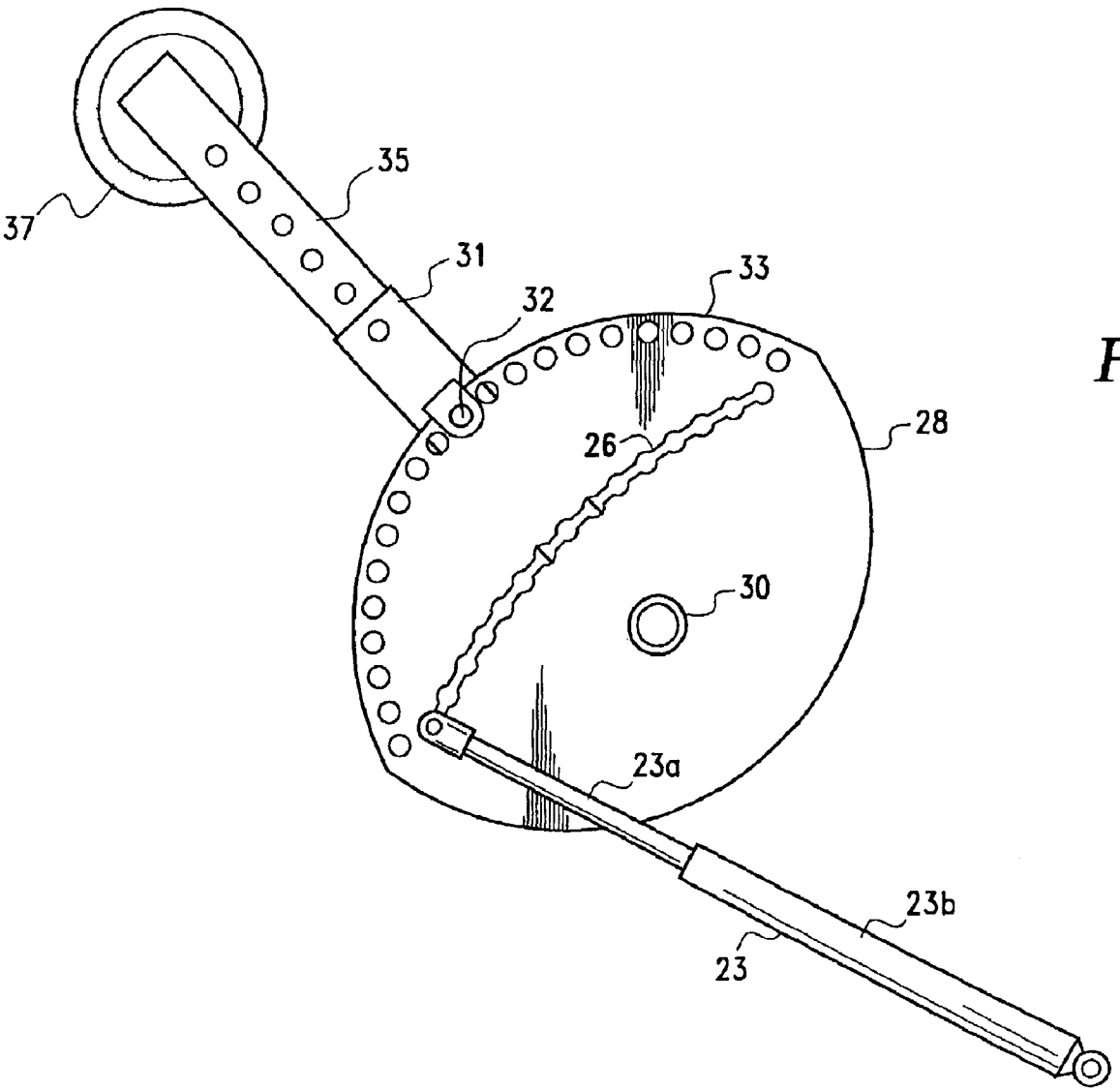
FIG. 4 is an exploded view of the force engine in assistance position.
Figure 6:
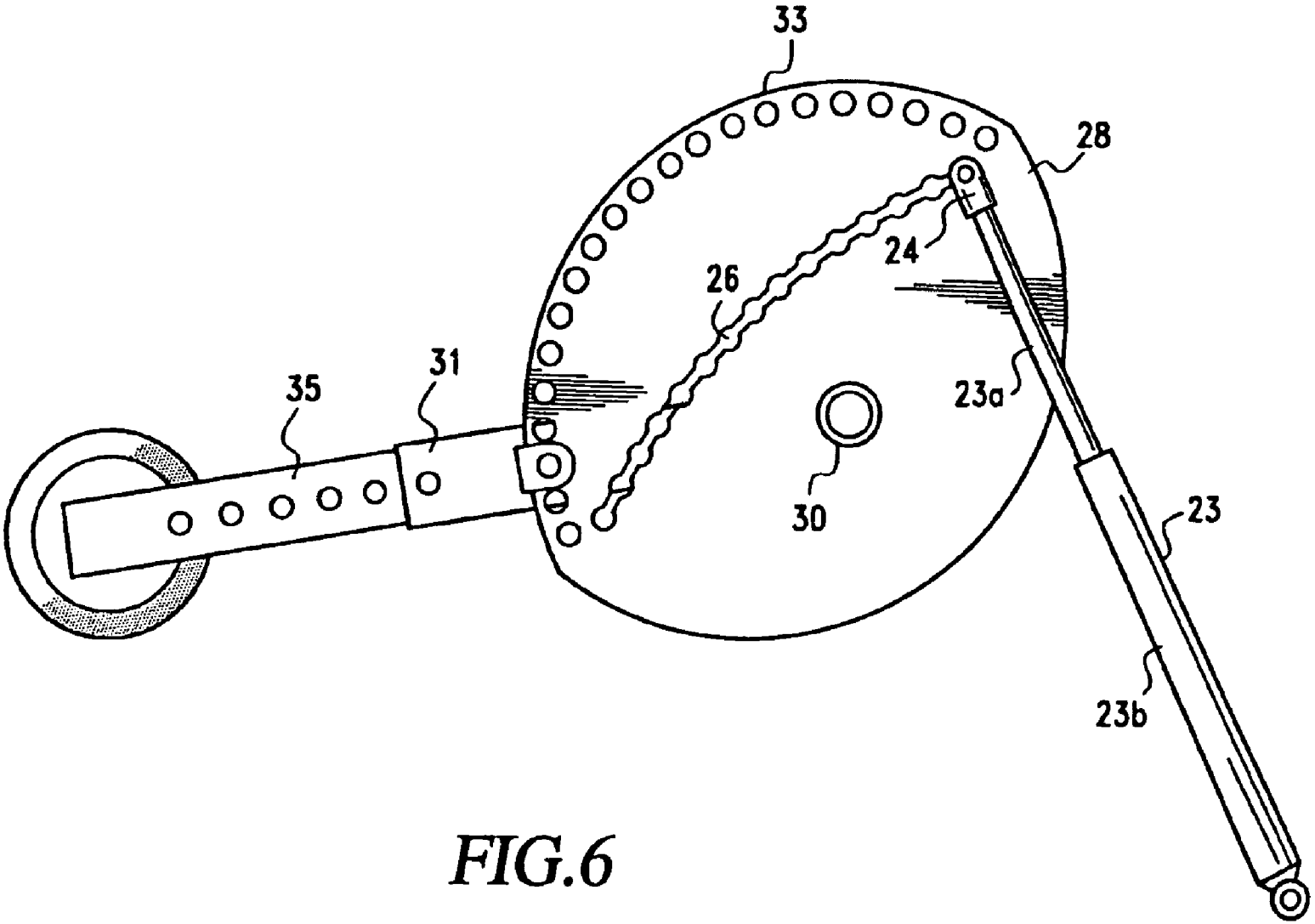
FIG. 6 is an exploded view of the force engine in resistive position.

FIG. 3 is an exploded view of the force engine in neutral position. The force engine can be selected for a range of assistive force or a range of resistive force. It is shown in a neutral position which would be like performing the exercise with no assistive or no resistive force. When the adjusting member (24) of the gas spring (23) is placed in the first notch of the force adjustment mechanism (26) this is selected for the most assistive force to the user (as shown in FIG. 4). When the adjusting member (24) of the gas spring (23) is placed in the last notch on the force adjustment member (26), this is selected for the most resistive force (as shown in FIG. 6). The adjusting member (24) of the gas spring (23) can be selected for any range in between for a varying degree of force.

During an assistive exercise, the guide arm (31) is preferably selected in the 5th hole of the dial plate force transferring mechanism (28) or in any hole to the last hole of the dial plate force transferring mechanism (28) as further described in FIGS. 7–10. During resistive exercise, the guide arm (31) is preferably selected in one of the first 5 holes of the dial plate force transferring mechanism (28).

It is possible to place the guide arm (31) in any hole (with the gas spring (23) in the assistive mode) and receive some assistive force. It is also possible to place the guide arm (31) in any hole (with the gas spring (23) in the resistive mode) and receive some resistive force.

FIG. 4 is an exploded view of the force engine in the assistive position with a gas spring force production mechanism. This figure shows the force engine in the assistive position at the top of the range of motion wherein the guide arm (31) is positioned at the halfway point or to the right of center. In operation, the weight of the user's body causes the guide arm (31) to rotate around the axis point (30) thereby causing the male cylinder (23*a*) of the gas spring (23) to compress into the female cylinder (23*b*) of the gas spring. At the bottom of the range of motion, the male cylinder (23*a*) retracts out of the female member (23*b*) due to the mechanisms of the gas spring (23) causing the guide arm (31) to push upon the user and assist with the movement of the body to the beginning point.

Figure 5:
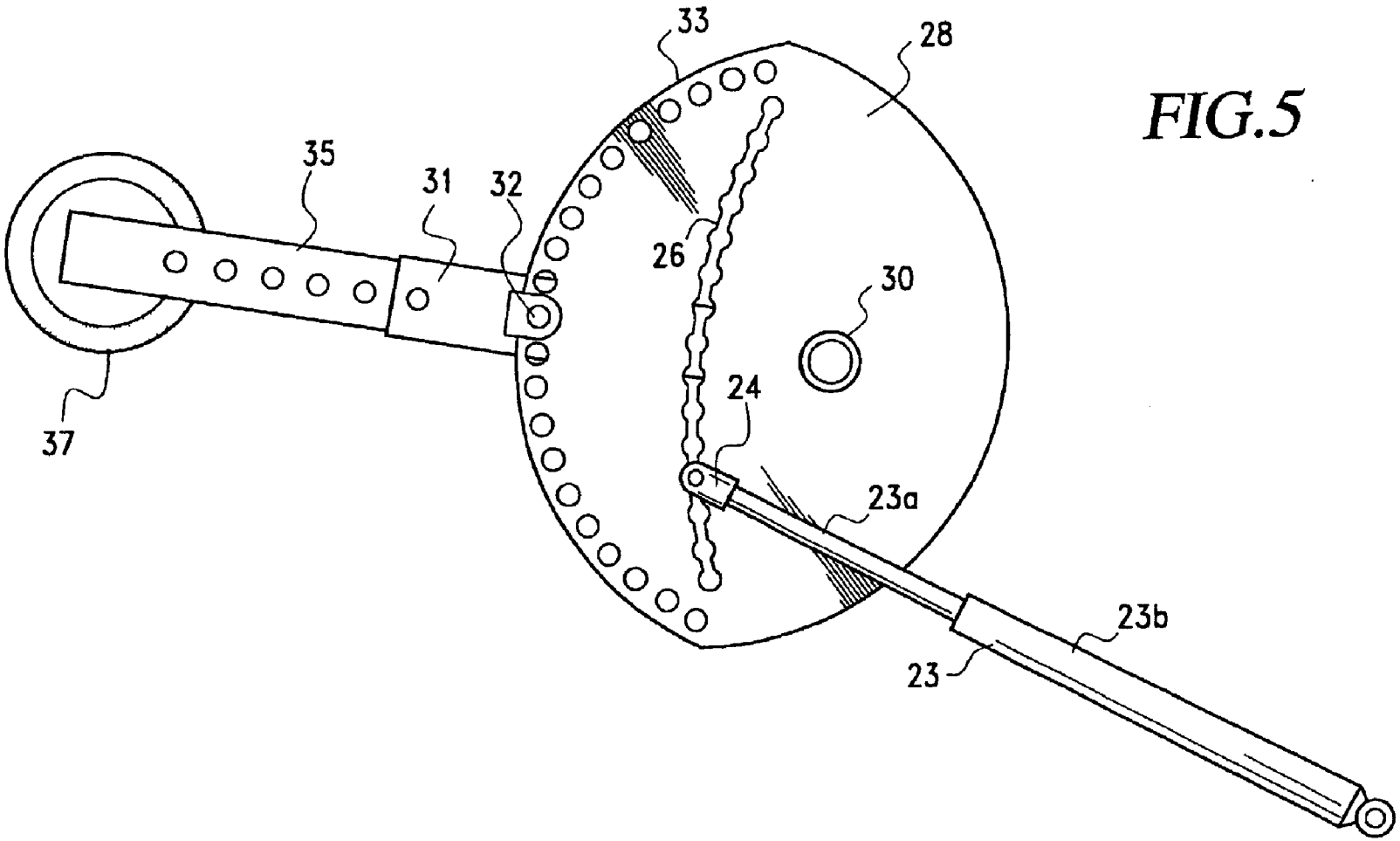
FIG. 5 is an exploded view of the force engine in assistive position in motion.

FIG. 5 is an exploded view of the force engine in the assistive position in motion. In this view, the gas spring (23) is selected for less assistive force than was shown in FIG. 4. The force engine is shown here with the dial plate force transferring mechanism (28) rotated from the starting position shown in FIG. 4 and the guide arm (31) is rotated downward (by the weight of the user's body). As shown, the male member (23*a*) is compressed into the female member (23*b*) which causes the force to be exerted when the male member (23*a*) retracts back again from the female member (23*b*).

FIG. 6 is an exploded view of the force engine in the resistive position with a gas spring force production mechanism. This figure shows the force engine in the resistive position at a declined range of motion wherein the guide arm (31) is positioned at the bottom half of the dial plate force transferring mechanism (28). In operation, starting at the bottom of the range of motion, the user pulls upon the guide arm (31) causing it to rotate around the axis point (30) thereby causing the male cylinder (23*a*) of the gas spring (23) to compress into the female cylinder (23*b*) of the gas spring (23) and increasing the force of the movement, thereby creating resistive force to the movement. At the inclined range of motion, the male cylinder (23*a*) retracts out of the female member (23*b*) due to the mechanisms of the gas spring (23) causing the guide arm to rotate downward with the movement of the body to the beginning point exerting the proper added force.

Figure 7:
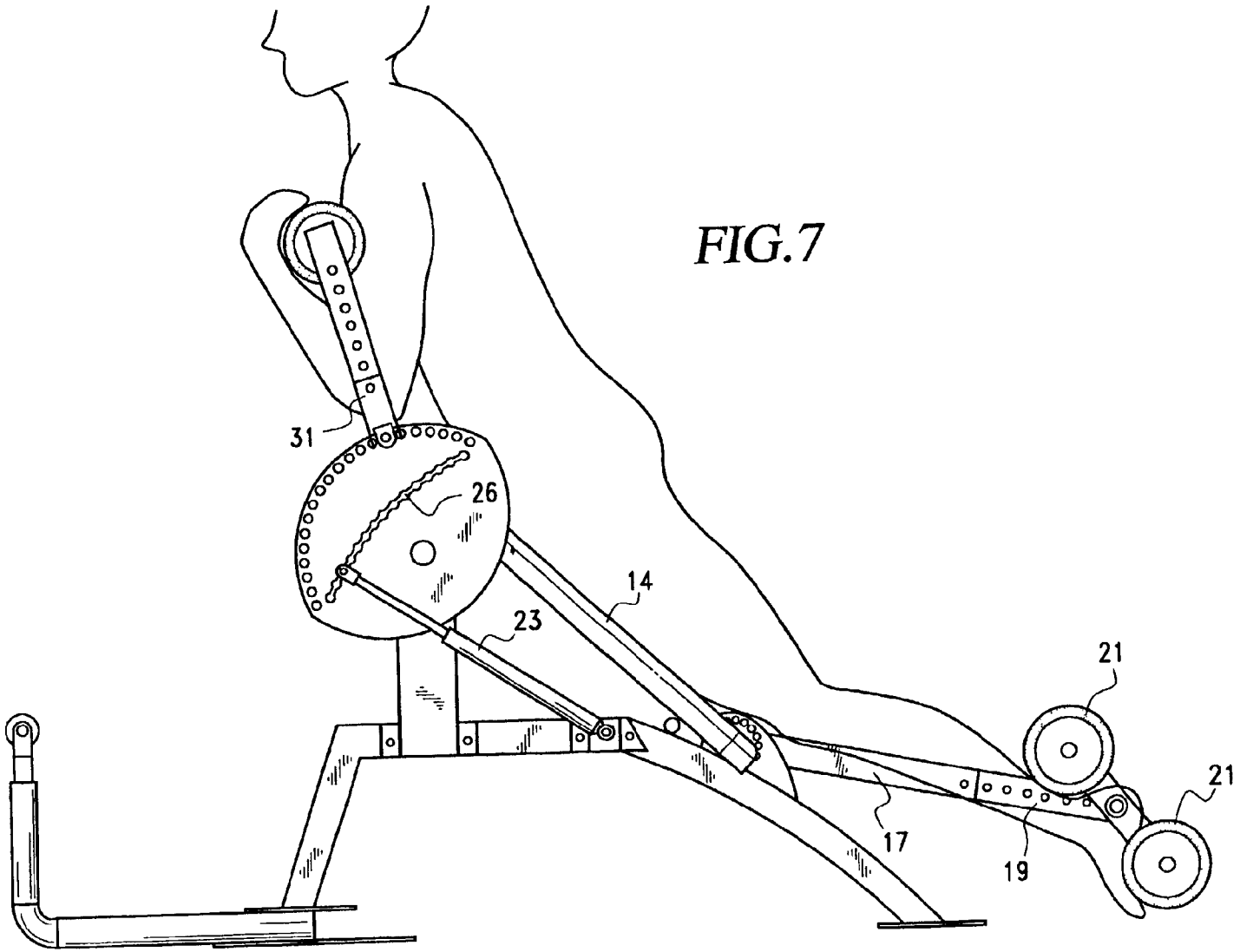
FIG. 7 is a side view of the variable gravity machine in use for back extension exercise.

FIG. 7 is a side view of the variable gravity machine in use for back extension exercise. In performing a back extension on the variable gravity machine, the user interfaces with the machine as shown wherein the ventral part of the user's torso contacts the guide arm; wherein the body pad is set at an angle and is contacted with the user's thigh; wherein the lower body support is set at an angle close to parallel to the floor and the user's feet engage the rollers to provide stability to perform the exercise. During the assistive exercise, the gas spring and guide arm are in a position as shown, the weight of the declining body causes the guide arm to rotate towards the floor thereby causing the force production as described in FIG. 4. During resistive exercise, the gas spring (23) is selected for the resistive position and the guide arm (31) is selected to a hole in the dial plate force transferring mechanism (28) which positions the user in a desired position to exert added resistance to the torso. During the resistive exercise, the user pulls upon the guide arm (31) by grasping the pads (37) of the guide arm (31) thereby exhibiting the resistive force as described in FIG. 6.

Figure 8:
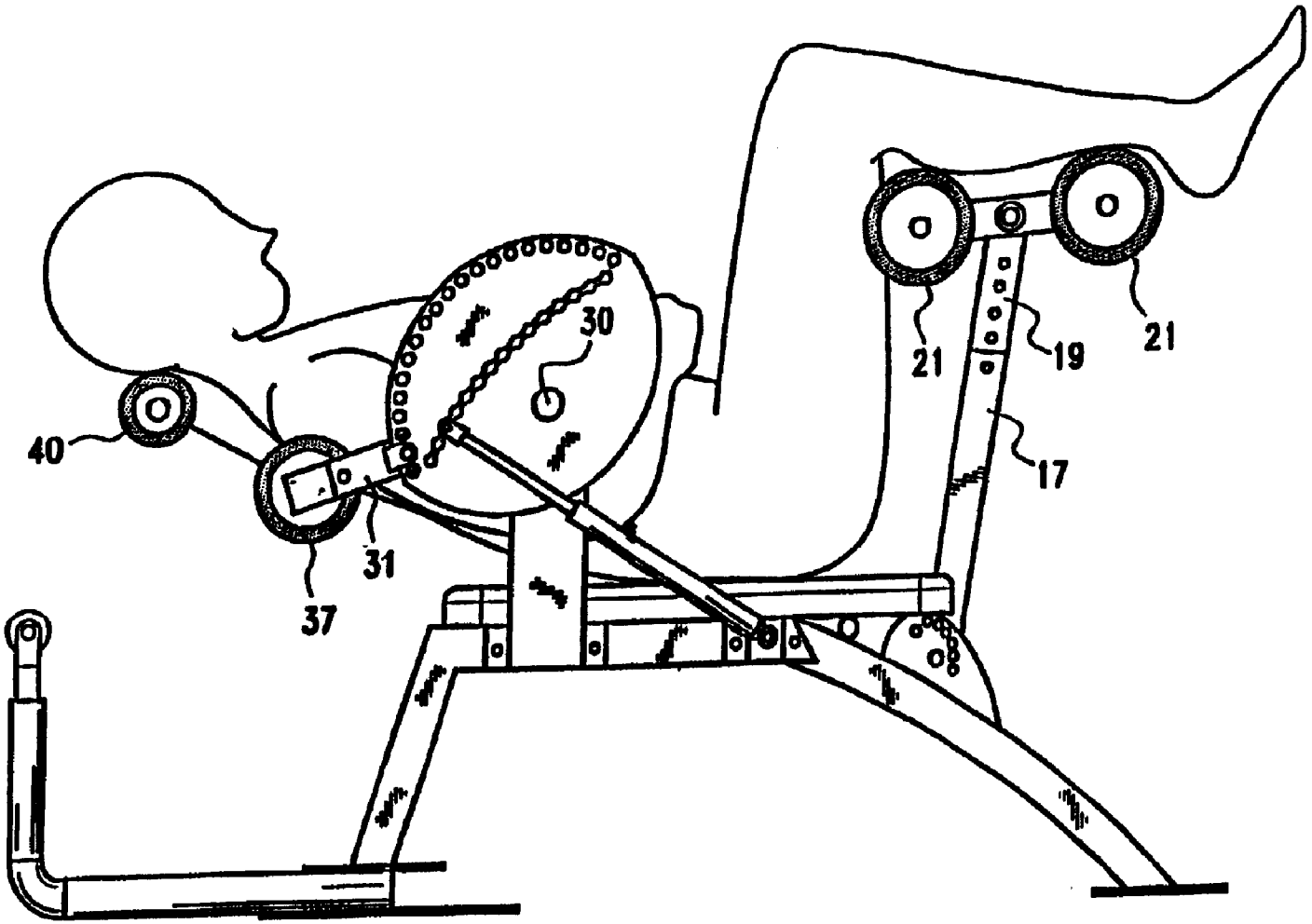
FIG. 8 is a side view of the variable gravity machine in use for a sit up.

FIG. 8 is a side view of the variable gravity machine in use for a sit up. In performing a sit up on the variable gravity machine, the user interfaces with the machine as shown wherein the dorsal part of the user's torso contacts the guide arm; the user's head and neck is supported by the head and neck support; wherein the user's lower back and glute muscles maintain contact with the body pad. The lower body support is set at an angle close to perpendicular to the floor and the back of the lower legs engage with the rollers (21) of the lower body support (18) to provide stability to perform the exercise. During the assistive exercise, the gas spring (23) and guide arm (31) are in the position as shown, the weight of the user's declining body causes the guide arm (31) to rotate toward the floor thereby causing the force production as described in FIG. 4. During resistive exercise, the gas spring (23) is moved to the resistive position. The guide arm (31) is selected to a hole in the dial plate force transferring mechanism (28) which positions the user in a desired position to exert added resistance to the torso. During the resistive exercise, the user pulls upon the harness-like means attached to the guide arm (31) or head support (40) rotating the guide arm (31) toward the ceiling. Thereby exhibiting the resistive force as described in FIG. 6.

Figure 9:
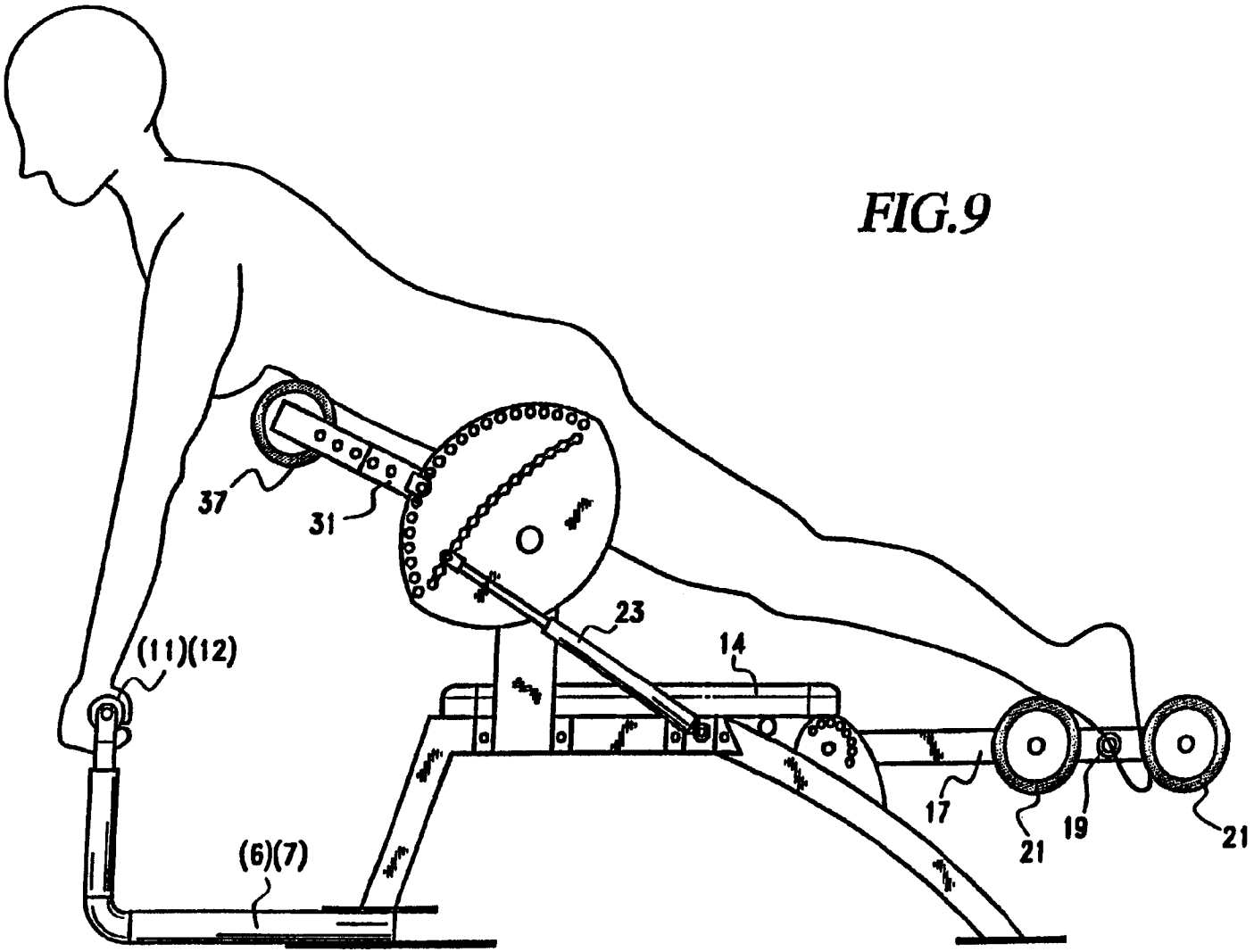
FIG. 9 is a side view of the variable gravity machine in use for a push up.

FIG. 9 is a side view of the variable gravity machine in use for a push up. In performing a push up on the variable gravity machine, the user interfaces with the machine as shown, wherein the ventral part of the user's torso contacts the guide arm (31); wherein the user grasps the push up handles( ) that are set at a desired position; wherein the lower body support (18) is set at an angle close to parallel to the floor and the feet of the user engage with the rollers (21) to provide stability to perform the exercise. During assistive exercise, the gas spring (23) and guide arm (31) are in the position as shown. The weight of the declining body causes the guide arm to rotate toward the floor. Thereby causing the force production as described in FIG. 4. During resistive exercise, the gas spring (23) is moved to the resistive position. The guide arm (31) is selected to a hole in the dial plate force transferring mechanism (28) which positions the user in a desired position to exert added resistance on the body. During the resistive exercise the user is connected to the guide arm by a belt or harness thereby allowing the user to pull upon the guide arm (31) rotating it toward the ceiling. Thereby exhibiting the resistive force as described in FIG. 6.

Figure 10:
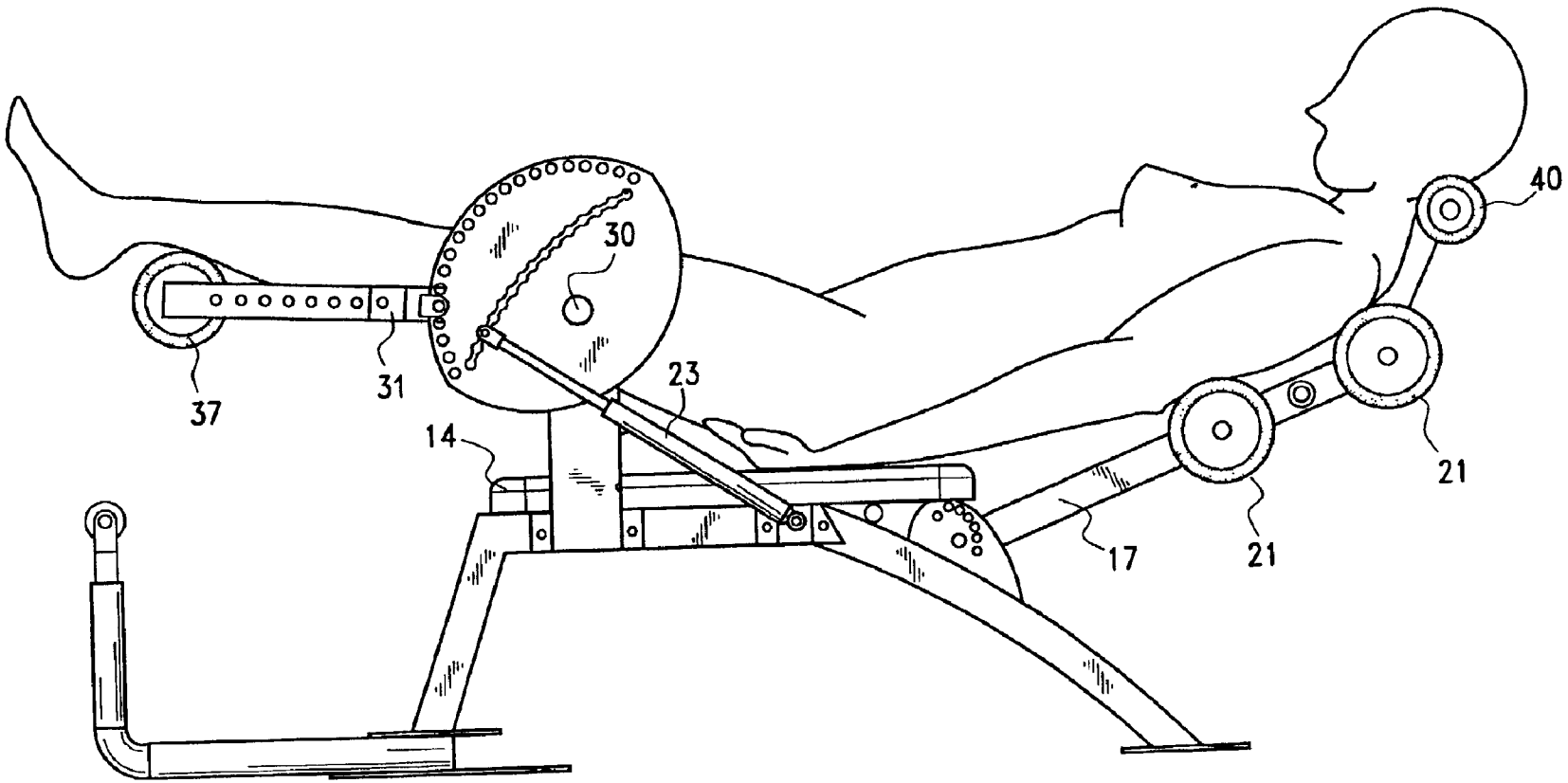
FIG. 10 is a side view of the variable gravity machine in use for a lower abdominal flexion.

FIG. 10 is a side view of the variable gravity machine in use for a lower abdominal flexion. In performing a lower abdominal flexion on the variable gravity machine, the user interfaces with the machine as shown wherein the dorsal part of the user's leg contacts the guide arm (31); wherein the lower body support (18) is set at a desired angle supporting the user's upper body; the rollers(21) contact the dorsal part of the torso; the head and neck support is positioned in a slot in the lower body support (18) to support the head. The user's lower back and glute areas contact the body with the users hands preferably positioned under the glute muscles to provide stability in the lower back.

During assistive exercise, the gas spring and guide arm are in the position as shown. The weight of the user's declining legs causes the guide arm to rotate toward the floor thereby causing the force production as described in FIG. 4. During resistive exercise the gas spring is moved to the resistive position. The guide arm (31) is selected to a hole in the dial plate force transferring mechanism (28) which positions the user in a desired position to exert added resistance on the legs. During the resistive exercise, the user is connected to the guide arm by a belt or harness thereby allowing the user to pull upon the guide arm (31) rotating it toward the ceiling thereby exhibiting the resistive force as described in FIG. 6.

Summary, Ramifications, and Scope

In summary, the present invention solves a problem that the prior art exercise and rehabilitation apparatus and machines do not address. The invention allows people who are obese, under conditioned, or injured to exercise their muscles according to the natural "real world" environment of isotonic resistance by reducing the resistive force of gravity on the body through use of a bi-directional force transferring mechanism attached to a force production mechanism. Additionally, the invention allows the body to move in such a way that is with the natural flow of movements of the body's muscles.

It may be true that the back extension device will innervate the multifidus muscles which are small muscles close to the spine under the para spinal muscles. The multifidus muscles, when weak, are considered to be the cause of many of the known back problems.

One legged isolated back extensions can be performed because of the guidance of the guide arm to the user. This will allow doctors to rehabilitate hamstring injuries with biomechanical specific methods.

With the aid of the retrofit adaptation one can get isotonic or isokinetic force from same device because of the nature and principles of the invention whereas most of the prior art apparatuses give only one or the other. The retrofit adaptation, an electrical/mechanical component, may make the exercise completely passive and it is also connected to a computer which provides computed measurements for the user. The retrofit adaptation, in the future, may be possible to exercise severely disabled people someday.

Unilateral exercises for bisecting body parts, such as the legs, may be able to be performed on the variable gravity machine.

What is claimed is:

1. An exercise apparatus adapted for selectively providing both supportive and resistive force, comprising:

a user support having a body pad with a first end and a second end and an auxiliary body support adjustably coupled to the user support adjacent the second end of the body pad, the auxiliary body support including a pivotally mounted pad assembly adapted for engaging different body parts in various orientations, the body pad having a longitudinal axis and a lateral extent extending perpendicular to the longitudinal axis and between a first side of the body pad and a second side of the body pad;

a guide member pivotally secured to the user support for movement relative thereto, the guide member including a user engaging support pad for contacting a user as an exercise routine is performed, the user engaging support pad extending substantially across the entire lateral extent of the body pad, wherein the guide member is adjustable relative to the user support and is substantially opposed to the auxiliary body support such that a user may support different body members on the guide member and auxiliary body support for performing various exercises; and a force producing assembly mechanically linked between the user support and the guide member, the force producing assembly selectively applying a biasing force in opposite directions.

2. The exercise apparatus according to claim 1, wherein the force producing assembly includes force producing means adjustably coupled between the user support and the guide member for selectively adjusting the force transmitted to the guide member.

3. The exercise apparatus according to claim 2, wherein the force producing assembly includes a rotating linking member to which the force producing means is adjustably coupled.

4. The exercise apparatus according to claim 3, wherein body pad is pivotally mounted to the user support adjacent the second end of the body pad.

5. The exercise apparatus according to claim 4, wherein the guide member consists of a single arm to which the user engaging support pad is mounted.

6. The exercise apparatus according to claim 1, wherein the user support, auxiliary body support and guide member are oriented for performing sit ups.

7. The exercise apparatus according to claim 1, wherein the user support, auxiliary body support and guide member are oriented for performing push ups.

8. The exercise apparatus according to claim 1, wherein the user support, auxiliary body support and guide member are oriented for performing back extensions.

9. The exercise apparatus according to claim 1, wherein the user support, auxiliary body support and guide member are oriented for lower abdominal flexion.

10. An exercise apparatus adapted for selectively providing both supportive and resistive force, comprising:

a user support having a body pad with a first end a second end and an auxiliary body support coupled to the user support adjacent the second end of the body pad, the body pad having a longitudinal axis and a lateral extent extending perpendicular to the longitudinal axis and between a first side of the body pad and a second side of the body pad;

a guide member pivotally secured to the user support for movement relative thereto, the guide member including a user engaging support pad for contacting a user as an exercise routine is performed, the user engaging support pad extending substantially across the entire lateral extent of the body pad and is transversely oriented across the user support such that a user may rest their torso thereupon while performing back extensions; and a force producing assembly mechanically linked between the user support and the guide member, the force producing assembly selectively applying a biasing force in opposite directions;

wherein the user support, auxiliary body support and guide member are oriented for performing back extensions.

11. The exercise apparatus according to claim 10, wherein the force producing assembly includes force producing means adjustably coupled between the user support and the guide member for selectively adjusting the force transmitted to the guide member.

12. The exercise apparatus according to claim 11, wherein the force producing assembly includes a rotating linking member to which the force producing means is adjustably coupled.

13. The exercise apparatus according to claim 12, wherein the body pad is pivotally mounted to the user support adjacent the second end of the body pad.

14. The exercise apparatus according to claim 13, wherein the guide member consists of a single arm to which the user engaging support pad is mounted.

15. A supportive back extension exercise apparatus adapted for providing an individual with support as a user moves between an upper first position and a lower second position during performance of back extensions, comprising:

an elongated user support having a horizontally oriented body pad with a first end and a second end, the body pad having a longitudinal axis and a lateral extent extending perpendicular to the longitudinal axis and between a first side of the body pad and a second side of the body pad;

a guide member pivotally secured to the user support for movement relative thereto between the first position and the second position wherein the first position is oriented above the second position and the guide member pivots about a substantially horizontal axis which is substantially adjacent to the first end of the body pad, the guide member including a transversely oriented support extending across the user support such that a user may rest their torso thereupon while performing back extensions, the transversely oriented support extending substantially across the entire lateral extent of the body pad; and a force producing assembly mechanically linked between the user support the guide member, the force producing assembly selectively applying a force biasing the guide member toward the first position such that as a user bends upon the user support with the torso of the user supported upon the guide member and the lower body of the user supported upon the body pad the force producing assembly will apply supportive force urging the user toward the first position as the user performs back extensions moving from the first position to the second position and moving from the second position to the first position.

16. The exercise apparatus according to claim 15, wherein the force producing assembly includes force producing means adjustably coupled between the user support and the guide member for selectively adjusting the force transmitted to the guide member.

17. The exercise apparatus according to claim 16, wherein the force producing assembly includes a rotating linking member to which the force producing means is adjustably coupled.

18. The exercise apparatus according to claim 17, wherein the body pad is pivotally mounted to the user support adjacent the second end of the body pad.

19. The exercise apparatus according to claim 18, wherein the guide member consists of a single arm to which the transversely oriented support is mounted.

20. The exercise apparatus according to claim 15, wherein the force producing assembly may selectively apply force in a direction urging the guide member toward the first position.

21. A multipurpose exercise apparatus adapted for providing an individual with support as a user moves between an upper first position and a lower second position during performance of an exercise, comprising:

an elongated user support having a first end and a second end, the user support including a horizontally oriented body pad and a pair of upstanding handles extending from the first end of the user support;

a guide member pivotally secured to the user support for movement relative thereto between the first position and the second position wherein the first position is oriented above the second position and the guide member pivots about a substantially horizontal axis, the guide member including a transversely oriented support extending across the user support such that a user may rest a body member thereupon while performing the exercise; and a force producing assembly mechanically linked between the user support and the guide member, the force producing assembly selectively applying a force biasing the guide member toward the first position such that as a user is supported against the effect of gravity as the user moves between the first position and the second position.

22. The exercise apparatus according to claim 22, wherein the force producing assembly includes force producing means adjustably coupled between the user support and the guide member for selectively adjusting the force transmitted to the guide member.

23. The exercise apparatus according to claim 22, wherein the force producing assembly includes a rotating linking member to which the force producing means is adjustably coupled.

24. The exercise apparatus according to claim 23, wherein the linking member includes a pivot point and the force producing means is adjustable to opposite sides of the pivot point.

25. The exercise apparatus according to claim 24, wherein the force producing means further includes a first end selectively coupled to the linking member for selective positioning superior or inferior to the pivot paint of the linking member.

26. The exercise apparatus according to claim 21, wherein the force producing assembly may selectively apply force in a direction urging the guide member toward the first position.

27. The exercise apparatus according to claim 21, further including an auxiliary body support adjustably coupled to the user support, the auxiliary body support including a pivotally mounted pad assembly adapted for engaging different body parts in various orientations.

28. A multipurpose exercise apparatus adapted for providing an individual with support as a user moves between an upper first position and a lower second position during performance of an exercise, comprising:

an elongated user support having a first end and a second end, the user support including a horizontally oriented body pad with a first end and a second end and an auxiliary body support adjustably coupled to the user support and extending from the second end of the user support adjacent the second end of the body pad, the auxiliary body support including a pivotally mounted pad assembly adapted for engaging different body parts in various orientations, the body pad having a longitudinal axis and a lateral extent extending perpendicular to the longitudinal axis and between a first side of the body pad and a second side of the body pad;

a guide member pivotally secured to the user support for movement relative thereto between the first position and the second position wherein the first position is oriented above the second position and the guide member pivots about a substantially horizontal axis, the guide member including a transversely oriented support extending across the user support such that a user may rest a body member thereupon while performing the exercise, the transversely oriented support extending substantially across the entire lateral extent of the user support; and a force producing assembly mechanically linked between the user support and the guide member, the force producing assembly selectively applying a force biasing the guide member toward the first position such that as a user is supported against the effect of gravity as the user moves between the first position and the second position.

29. The exercise apparatus according to claim 28, wherein the force producing assembly includes force producing means adjustably coupled between the set support and the guide member for selectively adjusting the force transmitted to the guide member.

30. The exercise apparatus according to claim 29, wherein the force producing assembly includes a rotating linking member to which the force producing means is adjustably coupled.

31. The exercise apparatus according to claim 30, wherein the body pad is pivotally mounted to the user support adjacent the second end of the body pad.

32. The exercise apparatus according to claim 31, wherein the guide member consists of a single arm to which the transversely oriented support is mounted.

33. The exercise apparatus according to claim 32, wherein the force producing assembly may selectively apply force in a direction urging the guide member toward the first position.

* * * * *